US011076648B2

(12) United States Patent
Benson et al.

(10) Patent No.: US 11,076,648 B2
(45) Date of Patent: Aug. 3, 2021

(54) DISPOSABLE OVER-THE-HEAD GOWN

(71) Applicant: Aspen Surgical Products, Inc., Caledonia, MI (US)

(72) Inventors: Barbara J Benson, Arden, NC (US); John M Sopcisak, Arden, NC (US)

(73) Assignee: Aspen Surgical Products, Inc., Caledonia, MI (US)

( * ) Notice: Subject to any disclaimer, the term of this patent is extended or adjusted under 35 U.S.C. 154(b) by 105 days.

(21) Appl. No.: 15/593,260

(22) Filed: May 11, 2017

(65) Prior Publication Data

US 2018/0000174 A1 Jan. 4, 2018

Related U.S. Application Data

(60) Provisional application No. 62/334,972, filed on May 11, 2016.

(51) Int. Cl.
*A41D 13/12* (2006.01)

(52) U.S. Cl.
CPC ..... *A41D 13/12* (2013.01); *A41D 13/129* (2013.01); *A41D 2400/44* (2013.01); *A41D 2400/52* (2013.01)

(58) Field of Classification Search
CPC .. A41D 13/12; A41D 13/129; A41D 2400/44; A41D 2400/52
See application file for complete search history.

(56) References Cited

U.S. PATENT DOCUMENTS 4,000,521 A * 1/1977 Zoephel ..... A41D 13/1209 2/114
4,017,909 A * 4/1977 Brandriff ..... A41D 13/1209 2/158
4,570,268 A * 2/1986 Freeman ..... A41D 13/1236 2/114
4,996,722 A * 3/1991 Jimenez ..... A41D 13/1227 2/114

(Continued)

FOREIGN PATENT DOCUMENTS

GB 1261390 1/1972

OTHER PUBLICATIONS

Form PCT/ISA/220, PCT Notification of Transmittal of the International Search Report and the Written Opinion of the International Searching Authority, or the Declaration, PCT/US2017/032286, dated Jul. 25, 2017.

(Continued)

*Primary Examiner* — Khaled Annis
(74) *Attorney, Agent, or Firm* — Price Heneveld LLP

(57) ABSTRACT

A gown, comprising: a body member having integral or attached side panels extending behind a front of the body member; wherein the side panels overlap each other behind the front of the body member; means for attaching together the side panels where they are overlapped; wherein the body member defines a neck opening and left and right arm openings; and wherein the gown comprises left and right sleeves attached at the left and right arm openings, respectively. The means for attaching comprises one of the group consisting of welding, spot welding, sonic welding, heat welding, hot or cold glues, adhesives, tapes, hook and loop fasteners, micro adhesives and dry adhesives.

19 Claims, 5 Drawing Sheets

(56) References Cited

U.S. PATENT DOCUMENTS 5,444,873 A * 8/1995 Levin ..... A41D 13/1236 2/114
6,115,839 A * 9/2000 Covington ..... A41D 13/1209 2/114
6,694,522 B1 * 2/2004 Neal ..... A41D 13/1236 2/114
7,546,643 B1 * 6/2009 De La Rotta ..... A41D 13/1209 2/114
2005/0044603 A1 * 3/2005 Graver ..... A41D 13/1236 2/69
2005/0044608 A1 * 3/2005 Ambrose ..... A41D 13/1209 2/114
2005/0132463 A1 * 6/2005 Kathumbi-Jackson ..... A41D 13/1209 2/51
2005/0132465 A1 * 6/2005 Kathumbi-Jackson ..... A41D 13/1209 2/114
2006/0117456 A1 * 6/2006 Griesbach, III ... A41D 13/1209 2/114
2011/0023210 A1 2/2011 Porowski
2011/0024485 A1 * 2/2011 Porowski ..... A41D 13/1209 229/87.16
2013/0191959 A1 * 8/2013 Quiroga ..... A41D 13/129 2/114
2013/0191960 A1 * 8/2013 Pasko ..... A41D 13/12 2/114
2013/0318682 A1 * 12/2013 Graneto, III ..... A41D 13/1236 2/114
2014/0026289 A1 * 1/2014 Schulties ..... A41D 13/1245 2/114
2014/0143985 A1 * 5/2014 Horton ..... A41B 1/10 24/303
2015/0059048 A1 * 3/2015 Stanley ..... A41D 13/129 2/69
2015/0135398 A1 * 5/2015 Czajka ..... A41D 13/12 2/114

OTHER PUBLICATIONS

Form PCT/ISA/210, PCT International Search Report for International Application No. PCT/US2017/032286, dated Jul. 25, 2017.
Form PCT/ISA/237, PCT Written Opinion of the International Searching Authority for International Application No. PCT/US2017/032286, dated Jul. 25, 2017.

* cited by examiner

DISPOSABLE OVER-THE-HEAD GOWN

CROSS REFERENCE TO RELATED APPLICATIONS

This application claims the benefit of the filing date of U.S. provisional patent application Ser. No. 62/334,972, filed on May 11, 2016, the entirety of which is incorporated herein by reference for all purposes.

FIELD OF THE DISCLOSURE

This disclosure relates generally to contamination and infection control products, and more specifically, to a disposable, over-the-head (OTH), full back isolation gown that is generally utilized by health care professionals and hospital visitors to certain units.

BACKGROUND

Disposable, OTH, isolation gowns are known, but those known gowns have various drawbacks. For example, many such disposable OTH, full back isolation gowns include various lines of perforations to aid in the removal of the gown. Such perforations increase the risk of the wearer being exposed to germs, viruses, infectious materials or other contaminants that may travel through such perforations. These perforations also make manufacture of the gowns more tedious and expensive.

As such there is an unfilled need for a full coverage gown that can be cost-effectively manufactured, donned by a user, doffed by the user, and worn by the user in such a manner as to minimize the incidence of contamination of the user via germs, viruses, and other infectious agents from another person or the immediate environment.

SUMMARY

One aspect of a preferred embodiment of the present disclosure comprises a gown, comprising: a body member having integral or attached side panels extending behind a front of the body member; wherein the side panels overlap each other behind the front of the body member; means for attaching together the side panels where they are overlapped; wherein the body member defines a neck opening and left and right arm openings; and wherein the gown comprises left and right sleeves attached at the left and right arm openings, respectively.

In another aspect of a preferred gown of the present disclosure, the means for attaching comprises one of the group consisting of welding, spot welding, sonic welding, heat welding, hot or cold glues, adhesives, tapes, hook and loop fasteners, micro adhesives and dry adhesives.

In yet another aspect, a preferred gown of the present disclosure further comprises one or more attachment sections within the overlap wherein the means for attaching is applied.

In another aspect of a preferred gown of the present disclosure, the means for attaching comprises one of the group consisting of welding, spot welding, sonic welding, heat welding, hot or cold glues, adhesives, tapes, hook and loop fasteners, micro adhesives and dry adhesives.

In yet another aspect, a preferred gown of the present disclosure has one elongated attachment section.

In yet an additional aspect, a preferred gown of the present disclosure has a plurality of attachment sections.

In another aspect of a preferred gown of the present disclosure, each of the plurality of attachment sections is oriented the same way as each of the other attachment sections.

In yet another aspect of a preferred gown of the present disclosure, each of the plurality of attachment sections is oriented differently as each of the other attachment sections.

In another aspect of a preferred gown of the present disclosure, the plurality of attachment sections are spaced apart and the spacings between consecutive attachment sections are uniform.

In a further aspect of a preferred gown of the present disclosure, the plurality of attachment sections are spaced apart and the spacings between consecutive attachment sections is varied.

In another aspect of a preferred gown of the present disclosure, the means for attaching creates attachments selected from the group consisting of permanent attachments, removable attachments and non-permanent attachments.

In yet another aspect of a preferred gown of the present disclosure, the gown is a disposable, over-the-head, full-back isolation gown.

Another aspect of a preferred embodiment of the present disclosure comprises an over-the-head isolation gown, comprising: a body member having integral or attached side panels extending behind a front of the body member; wherein the side panels overlap each other behind the front of the body member; an elongated weld attaching together the side panels where they are overlapped; wherein the body member defines a neck opening and left and right arm openings; and wherein the gown comprises left and right sleeves attached at the left and right arm openings, respectively.

Yet another aspect of a preferred embodiment of the present disclosure comprises an over-the-head isolation gown, comprising: a body member having integral or attached side panels extending behind a front of the body member; wherein the side panels overlap each other behind the front of the body member; a plurality of welds attaching together the side panels where they are overlapped; wherein the body member defines a neck opening and left and right arm openings; and wherein the gown comprises left and right sleeves attached at the left and right arm openings, respectively.

In another aspect of a preferred gown of the present disclosure, the welds comprise spot welds or sonic welds spaced apart from each other.

DETAILED DESCRIPTION

In the following detailed description, reference is made to the accompanying examples and figures that form a part hereof, and in which is shown, by way of illustration, specific embodiments in which the disclosure may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the disclosure may be referred to, individually and/or collectively, herein by the term "disclosure" merely for convenience and without intending to voluntarily limit the scope of this application to any single embodiment or concept if more than one is in fact disclosed.

The following description is, therefore, not to be taken in a limited sense, and the scope of the disclosure is defined by the appended claims and their equivalents.

Figure 1:
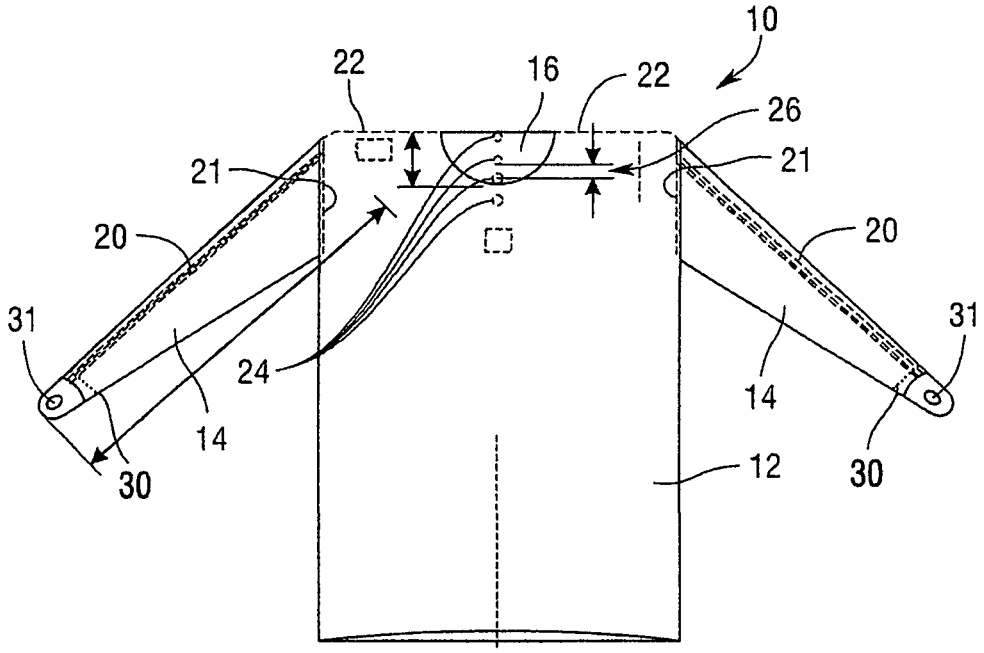
FIG. 1 is a front plan view of a preferred embodiment of a disposable OTH, isolation, full-coverage gown of the present disclosure.
Figure 2:
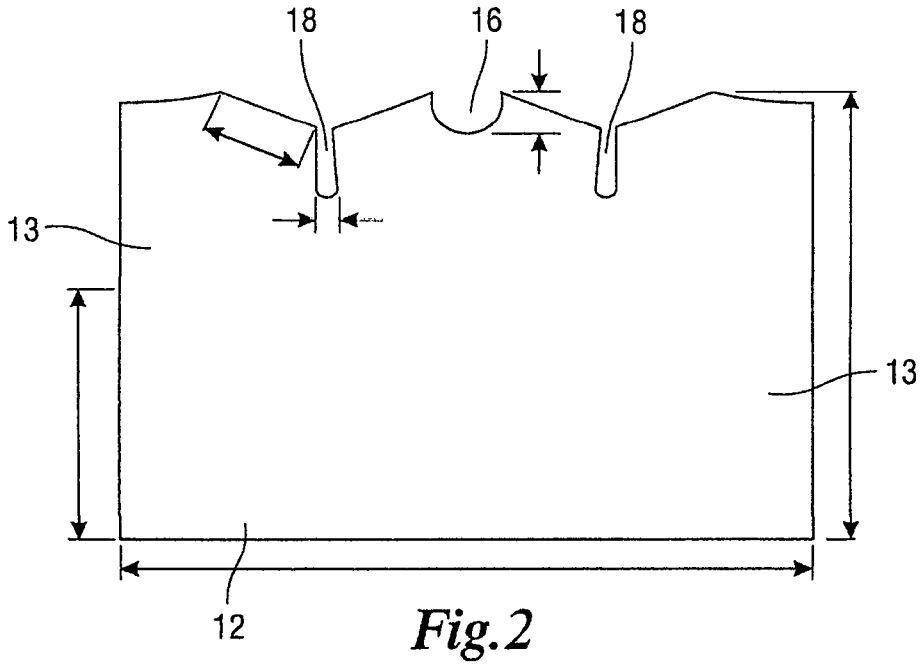
FIG. 2 is a front plan view of a preferred pattern of material for making a body member having integral side panels of a preferred embodiment of a disposable OTH, isolation, full-coverage gown of the present disclosure.
Figure 3:
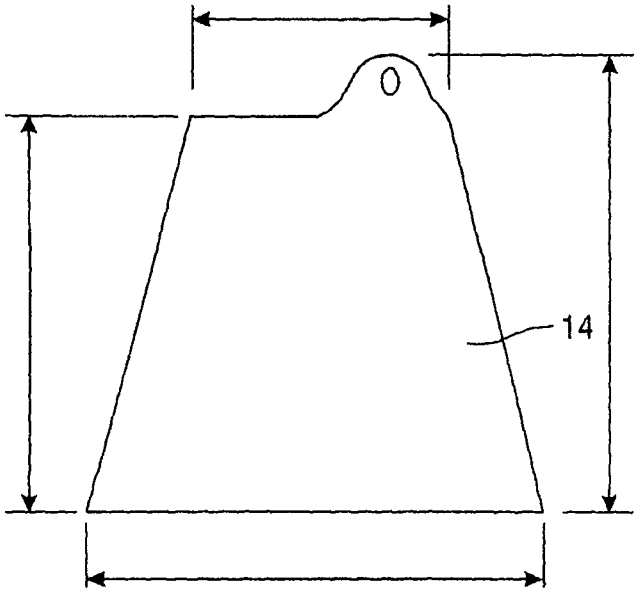
FIG. 3 is a front plan view of a pattern of material for making a sleeve of a preferred embodiment of a disposable OTH, isolation, full-coverage gown of the present disclosure.
Figure 4:
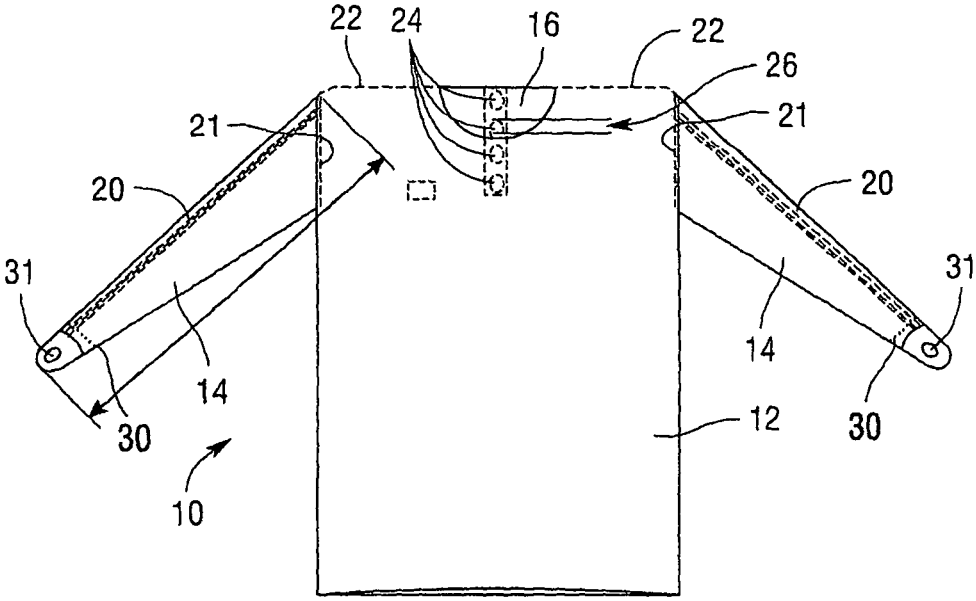
FIG. 4 is a front plan view of another preferred embodiment of a disposable OTH, isolation, full-coverage gown of the present disclosure.

FIGS. 1-6 show a preferred embodiment of a disposable OTH, isolation, full-coverage gown 10 of the present disclosure. As shown therein, a preferred disposable OTH, full back isolation gown 10 of the present disclosure comprises a one-piece or multi-piece body 12 defining side panels 13 foldable or extending rearward to form gown 10. Preferably, one or both side panels 13 may define a tab 15 (FIG. 6) to be folded back, as shown in FIGS. 8-11, to reinforce and strengthen the area where the two side panels 13 are attached together (by attachment sections 24, preferably spot welds or other means for attaching as described below) after being folded behind body 12 and overlapped. Body 12 also defines a neck opening 16 and arm-hole cut-outs 18 for forming arm-holes upon assembly of gown 10 for receiving sleeves 14 (FIG. 3). As shown in FIG. 1, after side panels 13 are folded into place, sonic welds (or by gluing, taping, or other attaching or joining means) are made on the shoulders 22, along the length of sleeves 14 at 20 and around the sleeve opening perimeters at 21 to form sleeves 14 and attach them to body 12, respectively. Preferably, sleeves 14 have elastic cuffs 30 and may define a thumb loop 31. Alternately, sleeves 14 may comprise a thumb loop 31 without elastic at the wrist, elastic at the wrist with no thumb loop or just a knit cuff.

Figure 5:
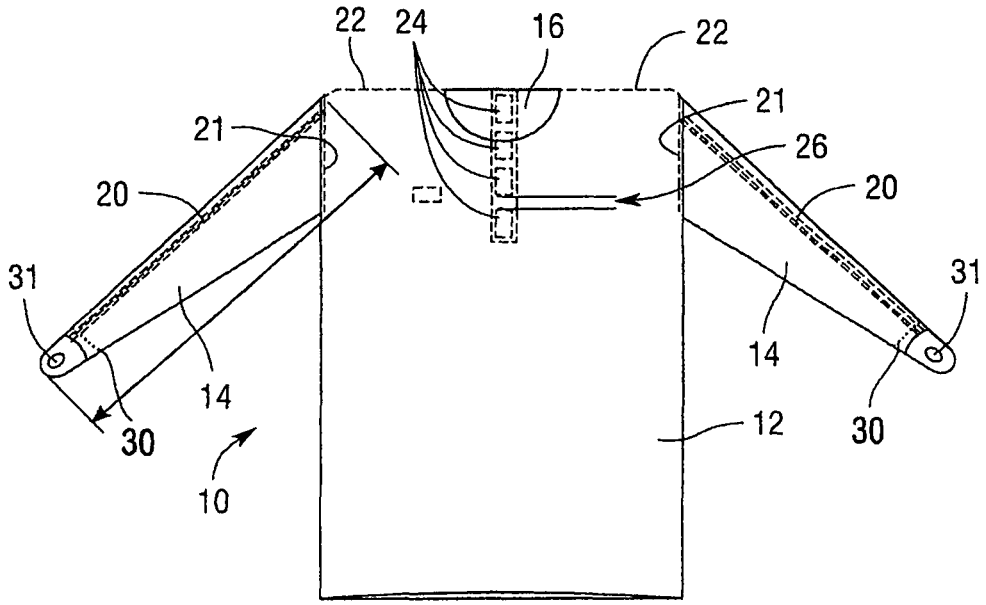
FIG. 5 is a front plan view of yet an additional preferred embodiment of a disposable OTH, isolation, full-coverage gown of the present disclosure.
Figure 6:
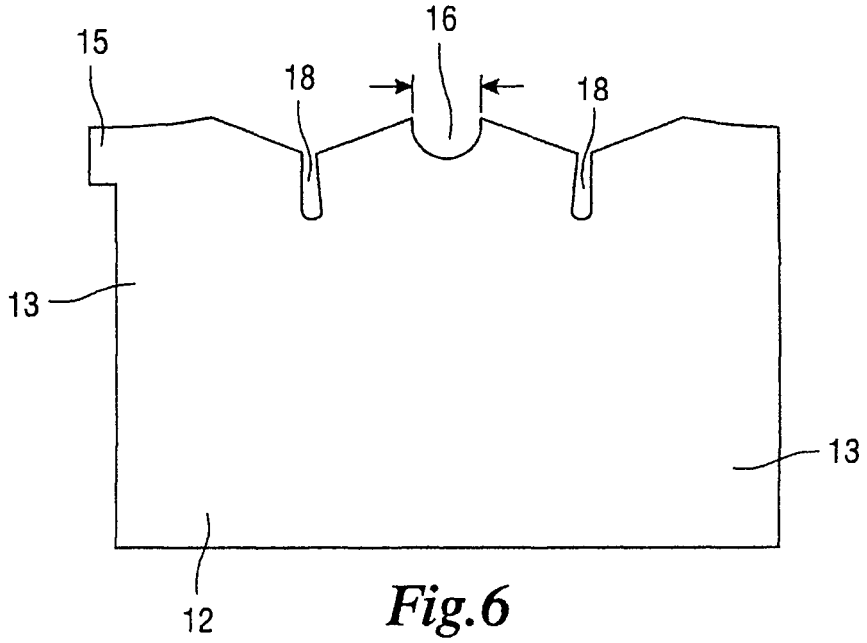
FIG. 6 is a front plan view of another preferred pattern of material for making a body member having integral side panels of a preferred embodiment of a disposable OTH, isolation, full-coverage gown of the present disclosure.

Preferably, one or more attachment sections 24 which preferably may comprise welds, spot welds, sonic welds, heat welds, hot/cold glues, adhesives, tapes, hook and loop fasteners, micro/dry adhesives (gecko inspired using small short-range electrostatic Van der Waals forces), etc., are used to attached the tops of side panels 13 to each other after they have been folded behind the front of gown 10 as shown in FIG. 1. Preferably, the attachment sections 24 provide a holding force sufficient to keep the gown 10 together during donning and use, but light enough to allow the bond between the side panels 13 to be broken for easy doffing after use. The preferred number, size, shape, orientation and placement of each of the attachment sections 24 may vary depending upon the material from which the gown 10 is made, upon the intended use of the gown 10 or for other factors. For example, when gown 10 is made from a polyethylene coated non-woven plastic material, such as spunbonded polypropylene (SBPP), attachment sections 24 preferably are rectangular in shape and spaced about 0.375 inches to about 1 inch apart in a vertical column as shown in FIG. 5. Also, when gown 10 is made from an spunbond/meltblown/spunbond (SMS) material, attachment sections 24 preferably are circular or oval in shape (FIGS. 1 and 4) and having a spacing 26 about 0.75 inches to about 1 inch apart in a vertical column. In the various preferred embodiments of the gown 10 of the present disclosure, one or more of the attachment sections 24 preferably may be oriented differently from each other and/or from the other attachment points/spot welds.

Figure 7:
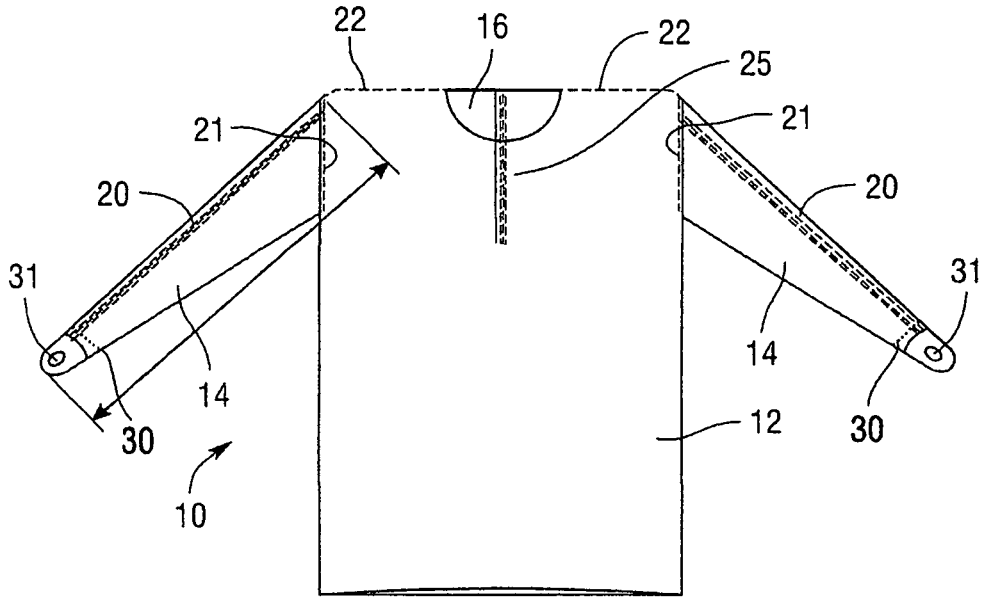
FIG. 7 is a front plan view of yet a further preferred embodiment of a disposable OTH, isolation, full-coverage gown of the present disclosure.
Figure 8:
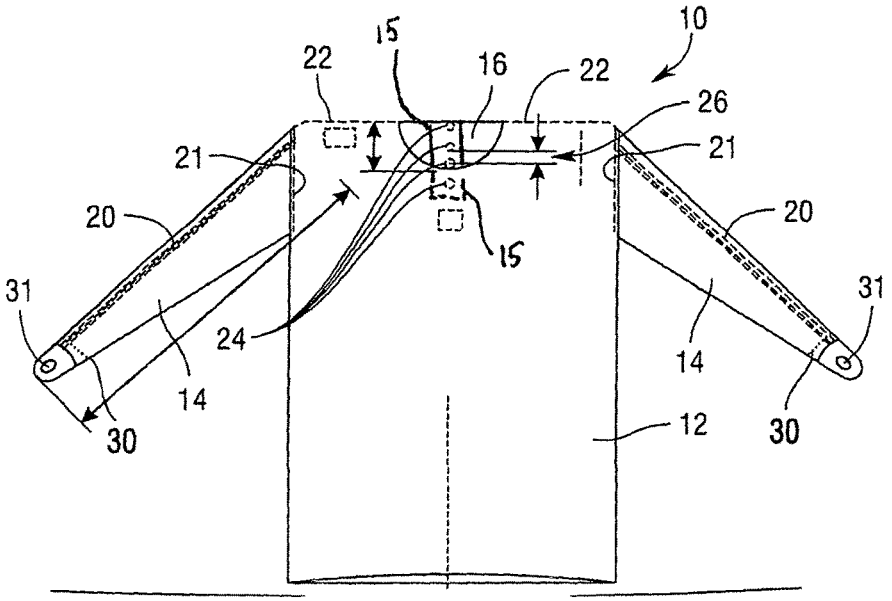
FIG. 8 is a front plan view of a preferred embodiment of a disposable OTH gown of the present disclosure showing tab 15 folded back to reinforce the area where the two side panels 13 are attached together (by attachment sections 24, preferably spot welds or other means for attaching as described herein) after being folded behind body 12 and overlapped.
Figure 9:
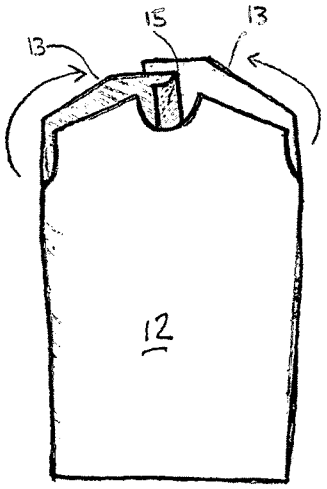
FIG. 9 is a partial exploded top perspective view of the disposable OTH gown of FIG. 8 showing how tab 15 is folded back to reinforce the area where the two side panels 13 are attached together.
Figure 10:
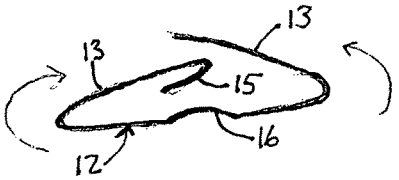
FIG. 10 is a partial exploded top plan view of the disposable OTH gown of FIG. 8 showing how tab 15 is folded back to reinforce the area where the two side panels 13 are attached together.
Figure 11:
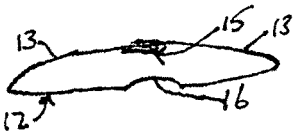
FIG. 11 is a top plan view of the disposable OTH gown of FIG. 8 showing how tab 15 is folded back to reinforce the area where the two side panels 13 are attached together.

FIG. 7 shows another preferred embodiment of a disposable OTH, isolation, full-coverage gown 10 of the present disclosure which is similar or identical to the other preferred embodiments described above except for the attachment of side panels 13. Preferably, the two side panels 13 in this preferred embodiment are attached together after being extended or folded behind body 12 and overlapped by a single elongated attachment section 25, preferably comprising a sonic or spot weld or other means for attaching which preferably may comprise welds, heat welds, hot/cold glues, adhesives, tapes, hook and loop fasteners, micro/dry adhesives (gecko inspired using small short-range electrostatic Van der Waals forces).

Gown 10 preferably can be made of different types of nonwovens, SMS, polyethylene coated SBPP, SBPP, film, and others.

Gown 10 preferably may be made from one piece or multiple panels forming one piece and then attached in the back of the gown about the neck and shoulder area as shown in FIGS. 1-6.

Gown 10 preferably may have the same or different lengths in the front or back.

Gown 10 represents an improvement over current gown designs in several ways.

Gown 10 represents a functional improvement over current OTH full coverage gown designs (isolation gowns require full coverage in the back). Current OTH full coverage gown designs have slits, perforation, or the like in the back of the gown that would allow for strike through if these area were contacted by infectious agents or contaminants. The gown 10 of the present disclosure is designed so that the attachment created by the attachment sections 24 in the back creates an overlap of side panels 13 along virtually the entire length of the back of the gown 10 to create a better full coverage gown.

Ease of removing/doffing gown 10 is achieved due to the attachment sections 24 being in a relatively small area about the neck that allows detachment without tearing through larger areas of material, as side panels 13 of gown 10 are preferably designed to release from each other at the attachment sections 24.

It will be readily understood to those skilled in the art that various other changes in the details, material, and arrangements of the parts and method stages which have been described and illustrated in order to explain the nature of this disclosure may be made without departing from the principles and scope of the disclosure as expressed in the subjoined claims.

In the foregoing description of preferred embodiments of the present disclosure, various features are grouped together in a single embodiment to streamline the disclosure. This method of disclosure is not to be interpreted as reflecting an intention that the claimed embodiments of the disclosure require more features than are expressly recited in each claim. Rather, as the following claims reflect, inventive subject matter lies in less than all features of a single disclosed embodiment. Thus, the following claims are hereby incorporated into the foregoing description, with each claim standing on its own as a separate embodiment.

What is claimed is:

1. An over-the-head gown, comprising:

a body member having side panels extending and overlapping behind a front of the body member, wherein the body member defines a complete neck opening prior to donning the gown and left and right arm openings, wherein a tab is integrally attached with and extends from one of the side panels, wherein the tab is disposed adjacent to a top edge of the respective side panel;

an attachment feature for attaching together the side panels where the side panels overlap at a back or side of said gown to form a back or a side part of the complete neck opening, wherein the tab is folded back to strengthen an area where the side panels overlap adjacent to or contiguous with the back or side of the complete neck opening and where the side panels are attached together by the attachment feature; and left and right sleeves attached at the left and right arm openings, respectively.

2. The over-the-head gown of claim 1, wherein the attachment feature includes at least one of welding, spot welding, sonic welding, heat welding, hot glues, cold glues, adhesives, tapes, hook and loop fasteners, micro adhesives, and dry adhesives.

3. The over-the-head gown of claim 1, further comprising:

multiple attachment sections, wherein the attachment feature is applied to each of the attachment sections.

4. The over-the-head gown of claim 3, wherein the attachment feature includes at least one of welding, spot welding, sonic welding, heat welding, hot glues, cold glues, adhesives, tapes, hook and loop fasteners, micro adhesives, and dry adhesives.

5. The over-the-head gown of claim 1, further comprising:

one elongated attachment section, wherein the attachment feature is applied to the one elongated attachment section.

6. The over-the-head gown of claim 1, further comprising:

a plurality of attachment sections, wherein the attachment feature is applied to each of the plurality of attachment sections.

7. The over-the-head gown of claim 6, wherein each of the plurality of attachment sections is oriented the same way as each of the other attachment sections.

8. The over-the-head gown of claim 6, wherein each of the plurality of attachment sections is oriented differently as each of the other attachment sections.

9. The over-the-head gown of claim 6, wherein the plurality of attachment sections are spaced apart and the spacings between consecutive attachment sections are uniform.

10. The over-the-head gown of claim 9, wherein the attachment feature creates at least one of permanent attachments and removable attachments between the side panels where the side panels overlap.

11. The over-the-head gown of claim 9, wherein said gown is a disposable, full-back isolation gown.

12. An over-the-head gown, comprising:

a body member having side panels extending behind a front of the body member, wherein the body member defines a complete neck opening and left and right arm openings, wherein a tab is integrally attached with one of the side panels adjacent to the complete neck opening, wherein the tab is folded back to strengthen an area adjacent to or contiguous with a back or side of said gown where the side panels overlap and are welded together by an elongated weld to enclose the complete neck opening; and left and right sleeves attached at the left and right arm openings, respectively.

13. An over-the-head gown, comprising:

a body member having side panels extending behind a front of the body member, wherein the body member defines a complete neck opening and left and right arm openings, wherein one of the side panels a includes an integrally attached tab adjacent to a top edge partially defining the complete neck opening and folded to strengthen an area adjacent to or contiguous with a back or side of said gown where the side panels overlap and are welded together by a plurality of welds to form a back or a side part of the complete neck opening; and left and right sleeves attached at the left and right arm openings, respectively.

14. The over-the-head-gown of claim 13, wherein the plurality of welds includes at least one of spot welds and sonic welds, and wherein the plurality of welds is arranged in a spaced apart configuration.

15. The over-the-head gown of claim 1, wherein each of the left and right sleeves defines a thumb loop at a distal end thereof.

16. The over-the-head gown of claim 1, wherein each of the left and right sleeves includes an elastic cuff at a distal end thereof.

17. The over-the-head gown of claim 1, wherein each of the left and right sleeves are coupled to the left and right sleeve openings, respectively, via a plurality of sonic welds arranged along a perimeter of each of the left and right sleeve openings.

18. The over-the-head gown of claim 17, wherein the plurality of sonic welds are arranged over shoulders of said gown to enclose the left and right sleeve openings, respectively.

19. The over-the-head gown of claim 1, wherein a plurality of welds is arranged along a length of each of the left and right sleeves to form the left and right sleeves, respectively.

* * * * *